United States Patent [19]

Berglowe, Jr. et al.

[11] 4,020,213

[45] Apr. 26, 1977

[54] MANUFACTURING AN INSULATED CONDUCTOR AND THE ARTICLE PRODUCED THEREBY

[75] Inventors: Sven Raymond Berglowe, Jr., Edgewood; Earl Salvator Sauer, Perry Hall, both of Md.

[73] Assignee: Western Electric Company, Inc., New York, N.Y.

[22] Filed: Mar. 20, 1975

[21] Appl. No.: 560,068

[52] U.S. Cl. ..... 428/379; 156/635; 174/110 V; 260/42; 427/120; 427/226; 427/314; 427/318; 156/664

[51] Int. Cl.[2] ..... B05D 5/12

[58] Field of Search ..... 427/120, 226, 388, 117, 427/318, 314; 264/341; 428/379, 383, 457, 463, 500, 522; 156/3, 4, 18; 174/110 V, 110 SR; 260/23 R, 42.21, 45.7 P, 45.75 R, 42

[56] References Cited

UNITED STATES PATENTS

| | | | |
|---|---|---|---|
| 3,171,866 | 3/1965 | Meyer et al. | 427/120 X |
| 3,333,050 | 7/1967 | Humphrey et al. | 427/120 X |
| 3,433,687 | 3/1969 | Price | 156/47 |
| 3,467,540 | 9/1969 | Schick | 427/120 X |
| 3,513,222 | 5/1970 | Speitel et al. | 260/836 |
| 3,579,608 | 5/1971 | De Coste | 260/837 |
| 3,657,381 | 4/1972 | Speitel et al. | 260/836 |
| 3,723,379 | 3/1973 | Althouse et al. | 260/31.8 M |
| 3,935,369 | 1/1976 | George et al. | 428/379 |

FOREIGN PATENTS OR APPLICATIONS

| | | | |
|---|---|---|---|
| 662,749 | 12/1951 | United Kingdom | 427/120 |

*Primary Examiner*—Thomas J. Herbert, Jr.
*Assistant Examiner*—Bruce H. Hess
*Attorney, Agent, or Firm*—E. W. Somers

[57] ABSTRACT

An electrical conductor is advanced along a path and is preheated to within a controlled temperature range. A reaction mixture is extruded about the conductor, the preheat of which causes the reaction mixture to release a reaction product that etches the surface of the conductor. This results in an insulated conductor unexpectedly having desired adhesion values of the insulation to the conductor without degrading the overall physical and mechanical properties of the insulation. In one usage, the reaction mixture is plasticized polyvinyl chloride with hydrochloric acid being released to perform the etching.

6 Claims, 11 Drawing Figures

MANUFACTURING AN INSULATED CONDUCTOR AND THE ARTICLE PRODUCED THEREBY

BACKGROUND OF THE INVENTION

1. Field of the Invention

This invention relates to manufacturing an insulated conductor and the article produced thereby, and, more particularly, to methods of applying a plastic covering to an electrical conductor to provide a plastic covered conductor having a controlled adhesion of the plastic covering to the conductor and the article produced thereby.

2. Prior Art and Technical Consideration

Insulated electrical conductors, such as those employed in telephone installations, are often subjected to outdoor use or to conditions that expose the insulation to the deteriorating influences of light, weather, and abrasion.

For example, it is important that plastic covered drop wire which brings telephone service from a telephone pole to a user be covered with an insulation material which has adequate properties to withstand exposure to the elements, as well as adequate low temperature flexibility, impact resistance, and abrasion resistance. An insulated conductor referred to as bridle wire which is used to field connect ends of open circuits and which is used in high density metropolitan areas must possess these same aforementioned qualities. Bridle wire may include a single conductor or a twisted pair.

The adhesion of the insulation to the conductive element in these wire products must fall within a predetermined range. Insufficient adhesion of the insulation to the conductors could cause the insulation to pull from the conductors with the entire weight of the wire in a catenary or in a vertical run held undesirably by the terminal connection. Insufficient adhesion could also lead to insulation cracking under wind loading which undesirably could allow moisture to contact the conductive element resulting in impairment of transmission quality and subsequent corrosion of the conductive element.

Too great an adhesion could require an excessive scraping activity during a stripping operation. This would remove some of the metallic material from the surface portion of the conductors thereby increasing the electrical resistance and changing the conductivity thereof, as well as reducing the strength properties of the wire to the detriment of its weight-supporting capability.

A composition of matter for producing a plastic covered drop wire was disclosed in U.S. Pat. No. 3,579,608 issued on May 18, 1971 to John B. DeCoste. See also Cogelia et al "All Vinyl Insulation for Aerial Drop Wire" pages 181–186 of *Bell Telephone Laboratories Record*, 6/74. One of the constituents in the DeCoste composition is a brominated epoxy resin while another uses a non-brominated epoxy resin. It has been found that the required adhesion values may be obtained by preheating a conductive element to within a predetermined temperature range and then extrusion coating one of the aforementioned compositions thereover. See copending commonly assigned application Ser. No. 412,362 filed Nov. 2, 1973 in the names of E. J. George, J. Salter, E. S. Sauer and C. E. Tidd and now U.S. Pat. No. 3,935,369, issued Jan. 27, 1976, incorporated by reference hereinto.

SUMMARY OF THE INVENTION

In accordance with the principles of the invention, methods are provided for covering a metallic strand material with a composition to provide a covered strand material in which the adhesion of the composition to the metallic strand material is controlled and is within a specified range of values.

A method of covering a conductor includes advancing the conductor along a path and contactingthe conductor with a reaction mixture comprising a plasticized polyvinyl chloride while the conductor is maintained at a suitable temperature sufficient to etch the outwardly facing surface of the conductor with a reaction product of the reaction mixture and to cause the reaction mixture to form a coating controllably adhered to the conductor.

BRIEF DESCRIPTION OF THE DRAWINGS

The various features of the invention will be more readily understood from the following detailed description when read in conjunction with the accompanying drawings wherein.

DETAILED DESCRIPTION

Figure 1:
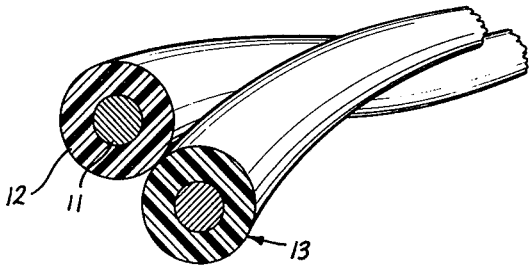
FIG. 1 is a cross-sectional view of a bridle wire including a twisted pair of conductors manufactured in accordance with the principles of this invention.

A strand material in the form of a conductive element 11 (see FIG. 1) to be insulated is a conductor having a diameter of approximately 0.038 inch. The conductive element 11 typically is a solid copper conductor about which is applied an insulation 12 to form an insulated conductor 13 which is referred to as bridle wire. Two of the insulated conductors 13—13 may be twisted together as shown in FIG. 1.

The insulation 12 in the past has typically been of the composition disclosed in U.S. Pat. No. 3,579,608 or in commonly assigned E. S. Sauer application Ser. No. 515,266 filed Oct. 16, 1974. The composition advantageously, may be changed in accordance with the principles of the invention.

Figure 3:
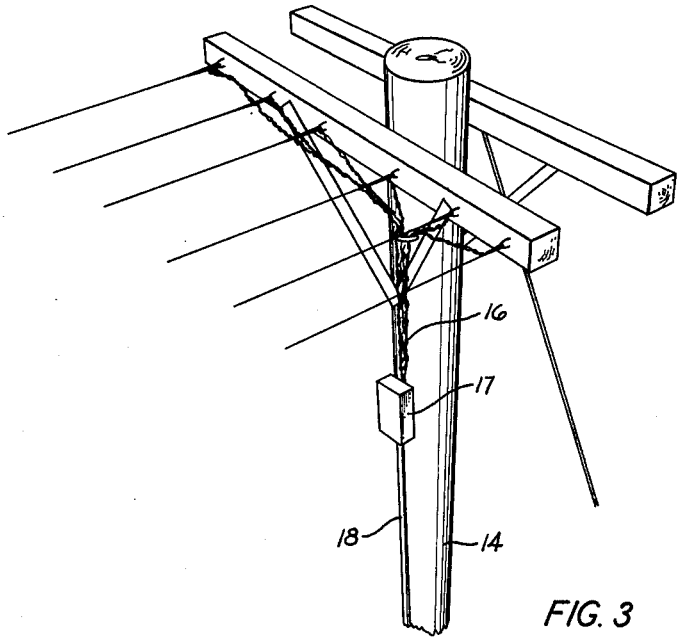
FIG. 3 is a perspective view showing a typical installation of the bridle wire complete with vertical runs thereof.

The bridle wire 13 is used in a variety of installations. For example, and as shown in FIG. 3, the bridle wire 13 is used to accomplish wiring of telephone equipment on telephone poles 14—14. Twisted pairs 16—16 of the bridle wire 13 may be run to an enclosure 17 with a vertical run 18 extending therefrom. Long vertical runs of the bridle wire 13 are common in many high density urban installations.

The adhesion is necessary to prevent the insulation from pulling off the conductor 11 due to the weight of wire in the long vertical runs referred to hereinabove or due to stresses induced by high winds. An insulation-to-conductor adhesion of about 2 to 30 lbs. is required.

While this invention is described principally with respect to the manufacture of the bridle wire 13, it is believed that the principles of this invention may also be applicable to the manufacture of what is referred to as a drop wire 21 as well as other electrical conductors where a controlled adhesion of the insulation to the conductive element is required. An insulation covering 22 is extruded simultaneously over a spaced pair of spaced electroformed cooper-clad steel conductive elements 23—23 to form the drop wire configuration shown in FIG. 2.

Figure 4:
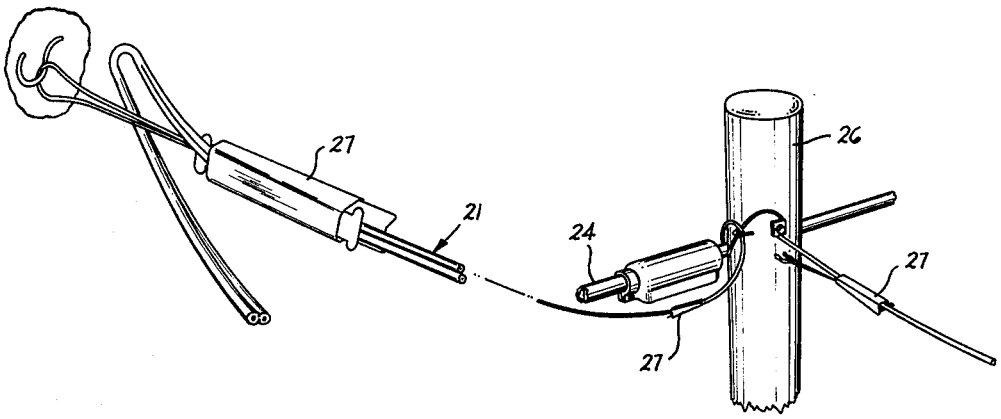
FIG. 4 is a perspective view showing a typical installation of the drop wire to a subscribers premises.

The drop wire 21 is used to bring telephone service from overhead aerial distribution cables 24 strung between telephone poles 26—26 to subscriber's premises (see FIG. 4). One end of the drop wire 21 is supported from a wedge-shaped clamp 27 attached to a pole 26 and then connected to the cable 24 while the other end is supported from a similar clamp attached to the subscriber's home. From there an electrical connection is made to conductors which are now inside the premises to the telephone handsets or other subscriber equipment.

The drop wire 21 forms generally a catenary between the two wedge-shaped clamps 27—27 with the weight of the drop wire causing forces to be exerted between the clamps and the ends of the drop wire. If there is insufficient adhesion between the insulation 22 and the conductors 23—23, the reaction of the clamp 27 on the drop wire 21 could cause the insulation layer to be pulled therefrom and the drop wire to be undesirably supported solely by the terminal connections.

On the other hand, excessive adhesion would render the drop wire extremely difficult to strip during an interconnection operation. In overcoming the adhesion to remove the insulation, an installer could knick the conductors 23—23. This may affect adversely the electrical properties of the conductors 23—23 as well as penetrate the copper cladding thereby exposing the steel core to possible corrosion.

Lastly, the composition as applied to the conductors 11 and 23 must have requisite physical and electrical properties and must not degrade during the processing thereof. For example, the composition must be tough, have adequate low temperature flexibility, acceptable resistance to compression, ultra-violet resistance, acceptable weatherability and adequate flame-retardance when used for drop wire because of the installation adjacent subscriber's premises.

The composition which is used to form the insulation covering 12 typically includes a polyvinyl chloride resin material, a homopolymer, (hereinafter referred to as PVC). The PVC resin has all the characteristics associated with the homopolymer, which includes some abrasion resistance, but which in and of itself is unstable. However, when the PVC resin is caused to soften during processing, which is necessary to process the composition, resistance to abrasion is reduced. Further, the PVC must be a suitable electrical grade homopolymer. Commercial PVC polymers which may contain up to 20 percent, or preferably up to a maximum of 10 percent, by weight of comonomers or other admixed materials such as propylene may be used. For example, PVC vinyl acetate or PVC polypropylene may be used without significant dverse effect.

The PVC resin may be any of a number of PVC resins well known in the art for use in electrical insulation. In accordance with the ASTM Standard for 1966, several PVC resins may be classified as within the range of from GP5-00003 to GP6-00003, inclusive. Definition of these characteristics are set forth in the ASTM Standard under designation D1755-66.

Briefly, the designation, GP, designates a general purpose resin primarily intended for calendaring, extrusion or molding processes. The first numerals (entries 5 through 6) represent a polymer molecular weight in terms of dilute solution viscosity and the last digit, 3, indicates the usual preference for an electrical conductivity les than 6 micromhos per centimeter per gram. This electrical characteristic is, of course, not a basic requirement from the standpoint of the inventive teaching. The bar under or the bar over a numeral indicates a value less than or more than, respectively, the cell classification for that numeral. The four ciphers in the designations indicate that the properties of particle size, apparent bulk density, plasticizer absorption and dry flow are at the discretion of the customer in that any ASTM cell classification may be used.

It is convenient to discuss concentrations in terms of parts by weight based on 100 parts of polymeric material. The term polymeric material is defined as consisting essentially of the PVC homopolymer. Concentrations so designated, therefore, result in compositions having greater than 100 parts.

Combined with the PVC homopolymer resin, is a phthalate plasticizer which is included to impart specific physical properties to the composition. The plasticizer provides a suitable degree of low-temperature flexibility to the composition. This is necessary to render the bridle wire 13, for example useable in a wide variety of environmental conditions. The plasticizer also facilitates the processing of the compound in the mixing thereof and in the application to the conductors 11—11.

The phthalate plasticizer in a preferred concentration is added to the polyvinyl chloride and is about 48 parts by weight, per 100 parts by weight of the PVC. If less than 45 parts by weight are employed, the composition would have unacceptably low temperature flexing properties. If this constituent is added to the composition in an amount greater than 55 parts by weight, per 100 parts by weight of the composition, the electrical properties of the insulation 12 are impaired as in the compressive strength thereof. The insulation 12 becomes softer which is an unacceptable feature of a drop wire.

A suitable phthalate plasticizer is one which is designated Santicizer-711 as marketed by Monsanto Industrial Chemicals Company. For others, see priorly identified appl. Ser. No. 515,266 filed Oct. 16, 1974.

Combined with the PVC and the phthalate plasticizer is a metallic stabilizer. The stabilizer is added to the compositions in order to provide the composition with heat stability during the extrusion thereof and to improve the electrical resistivity of the composition. Without a heat stabilizer, the composition may undergo thermal degradation during the processing thereof, causing the resulting bridle wire 13 to be unacceptable. The stabilizer has also been found to improve the weathering properties of the bridle wire 13.

A preferred concentration of the metallic stabilizer has been found to be about 5 parts by weight per 100 parts by weight of the PVC. If less than 3 parts by weight are used, the heat stability of the composition during mixing and at the extruder is reduced with subsequent reduction in processing time. This causes unsatisfactory processing with degraded material being applied to the conductors 11—11. On the other hand, an increase beyond 7 parts by weight produces only slight gains in heat stability at a disproportionate increase in composition cost.

It has been found that a metallic stabilizer such as a dibasic lead phosphite as marketed by N. L. Industries, Inc. under the designation "Tribase" E-XL is satisfactory for purposes of this composition. Tribase E-XL is a trademark product including a basic lead silicate sulfate having a specific gravity of 4.0 and a lead oxide content of 64.5%.

Combined with the stabilizer is a filler system which serves as an extender for the composition. The filler system may include any one of or all of ingredients such as calcium carbonate, fumed silica and a calcined clay for the drop wire 21 or simply a calcined clay for the bridle wire 13. The calcium carbonate, which was the only filler disclosed in the drop-wire composition patented by J. B. DeCoste, may detract somewhat from the low temperature properties thereof. In order to diminish this potential adverse effect, the calcium carbonate has been reduced and supplemented by the other above-identified fillers.

A preferred concentration of the filler system for producing bridle wire is approximately 3 to 10 parts by weight per 100 parts by weight of the PVC. If the filler system constitutes less than the parts specified, the filler system becomes ineffective with the electrical properties of the composition being sacrificed. The higher the filler concentration, the lower the plasticizer concentration and generally the better are the electrical properties. On the other hand, if more than the parts specified of the filler system are used, the low temperature flexibility and impact properties of the composition are affected adversely.

A suitable calcined clay is one marketed by Burgess Pigment Company and designated as 30P or a P33 calcined clay marketed by Freeport Kaolin Company.

Combined with the dibasic lead phosphite and the calcined clay in the blend is a lubricant. The lubricant is used to impart extrudability to the composition. One such lubricant which has been found to be suitable for purposes of this composition is dibasic lead stearate. It has been found that a preferred concentration of the lubricant is approximately $0.5 \pm 0.25$ parts of weight per 100 parts by weight of the blend. Less than 0.25 part provides inadequate lubrication while more than 0.75 parts does not increase noticeably the lubricity of the composition.

Added to the dibasic lead phosphite, the dibasic lead stearate and the calcined clay is a black color concentrate, which adds ultra violet light and weather resistance to the composition as well as providing additional filling properties.

A preferred concentration of the black concentrate has been found to be approximately one to three parts by weight per 100 parts by weight or the PVC. Less than one part by weight causes insufficient protection against degradation of the bridle wire 13 due to ultraviolet light and heat exposure while greater than three parts by weight are unnecessary to protect the composition against these forces.

The weathering properties of the polyvinyl chloride composition are improved substantially by the inclusion of the black concentrate. It has been found that maximum protection is obtained by using a finely divided channel or furnace black with a maximum particle size of 25 $\mu$m. The carbon black must be well dispersed throughout the composition in order to be most effective.

It has been found that a suitable carbon black material for use in this composition is one designated Superba 999, as manufactured by the Cities Service Company.

Figure 2:
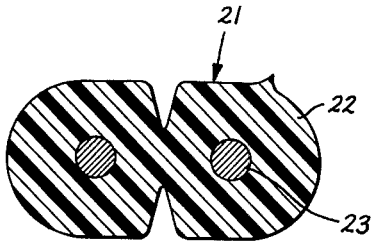
FIG. 2 is a cross-sectional view of a drop wire covered with an insulating composition and manufactured in accordance with the principles of this invention.

The principle of this invention may also be used to produce the drop wire 21 shown in FIG. 2. The drop wire 21 including the composition of the insulation 22 thereof is disclosed in priorly identified application Ser. No. 515,266, filed Oct. 16, 1974. A small amount of epoxy resin is used primarily to impart low-temperature impact resistance to the wire 21.

It is to be noted that a preferred composition of the drop wire insulation 22 which gives optimum adhesion values comprises 100 parts by weight of a polyvinyl chloride (PVC), 4 parts by weight per 100 parts by weight of the PVC of a non-brominated epoxy resin having a weight per epoxy equivalent of approximately 190, 66 parts by weight per 100 parts by weight of the PVC of a phthalate plasticizer, 5 parts by weight per 100 parts by weight of the PVC of a metallic stabilizer, 3 parts by weight per 100 parts by weight of the PVC of antimony trioxide, 2.5 parts by weight per 100 parts by weight of the PVC of a carbon black constituent, 5 parts by weight per 100 parts by weight of the PVC of fumed silica and 5 parts by weight per 100 parts by weight of the PVC of calcined clay.

It should be noted that while this invention has been described with respect to the production of bridle wire 13 and the drop wire 21 and their respective insulation composition, the invention is applicable to other compositions. The principle of the invention may be used to cover a preheated-elongated metal member with a reaction mixture, which could be also, for example, chlorinated polyethylene or a brominated constituent, which causes the liberation of a reaction product at the elevated temperature, e.g., an acid, to etch the surface of the member and achieve a desired adhesion.

METHODS OF APPLYING THE COMPOSITION

The principles of the methods of this invention are used to apply the composition to metallic strand material in the form of the conductor 11 such that there is an optimum adhesion between the conductors and the composition. This must be determined from a consideration of several factors.

An adhesion of the composition to each conductor 11 in the neighborhood of approximately 15 pounds is preferred with limits of 2 to 30 pounds being permitted. If the adhesion is less than 2 pounds, in insulation may pull away from the wire in the long vertical runs subject to wind and other external forces. If the adhesion is greater than approximately 30 pounds, then it becomes very difficult to strip the insulation 12. An installer could inadvertently scrape the conductors 11—11 thereby increasing the electrical resistance and changing the conductivity of the conductors.

The conductor preheat temperatures taught in the prior art did not result in an insulated conductor having the desired permanent adhesion characteristics of insulation to metal. It was believed that if a temperature in excess of 482° F, a maximum value quoted in the prior art, was used, that there would be adverse effects on the final product.

The use of conductor preheat temperature as later taught in the George et al application Ser. No. 412,362 filed Nov. 2, 1973 results in a drop wire having the desired permanent adhesion characteristics of insulation to metal. This occurred as a result of preheating the conductor in a range of 525° to 675° F and then extruding thereover a composition including an epoxy resin adhesion promoter such as that disclosed and claimed in DeCoste, U.S. Pat. No. 3,579,603, incorporated by reference hereinto, or in the priorly identified Sauer application Ser. No. 515,266 filed Oct. 16, 1974.

Figure 7:
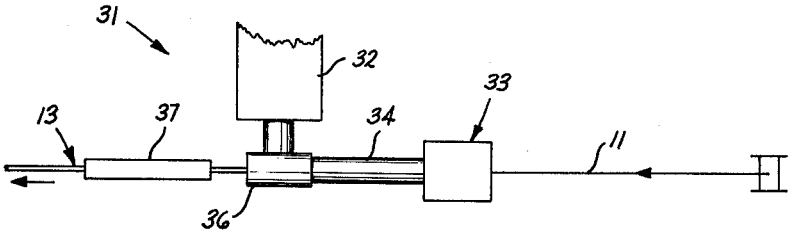
FIG. 7 is a view of an apparatus for applying the composition to the wire in accordance with the principles of this invention.

In practicing the method embodying the principles of this invention, a coppr conductor 11 destined to be enclosed with the reactive mixture is advanced along a manufacturing line, designated generally by the numeral 31 (see FIG. 7). The composition is applied to the conductors 11—11 as they are advanced through a dual channel core tube (not shown) of an extruder 32.

Prior to the entry of the conductors 11 into the extruder 32, the conductors are preheated to a temperature in the range of 525° F to 650° F and preferably in a range of 525° F to 575° F. The preheating of the conductors 11 may be accomplished by any number of conventional preheating facilities, designated generally by the numeral 33, including inductive-resistance heating. In order to prevent excessive heating of the conductor 11 and to minimize convective and radiation heat losses, the conductors are advanced through an insulated chamber 34 interposed between the preheating facilities 33 and the extruder 32.

In the process of preparing the composition for application to the conductor 11 in accordance with the principles of this invention, the PVC admixed with other compounding ingredients heretofore disclosed are fed into and thorugh the extruder 32. The details of the extruder 32 are well known in the art and are described in the aforementioned George et al. application Ser. No. 412,362.

The material flows toward a die 36 and ultimately toward engagement with the conductor 11 passing through the die. It will be recalled that a definite preheat has been imparted to the conductor 11 which is moved continuously through the crosshead die 36. In this way, the composition is extruded over the preheated conductor which is moved continuously through the die 36 and which acts as internal forming mandrels.

After the insulated conductor 13 emerges from the die 36, the conductor is advanced into cooling trough 37. The entrance to the cooling trough 37 is typically 2 ft. from the die 36. Typically, the cooling trough contains chilled water at a temperature of approximately 40° F which is used to cool the insulation 12. Subsequently, the insulated conductor 13 is taken up and in some instances prepared for twisting.

Previously, the epoxy resin was identified as the constituent primarily relied on the obtain the requisite average adhesion of the insulation to the drop wire conductors. It has been found surprisingly that a copper conductor may be insulated with PVC composition which has excellent wire-to-insulation adhesion values notwithstanding the absence of an epoxy resin in the PVC composition.

The requisite wire-to-insulation adhesion value is obtained by subjecting the reaction mixture to the conductor 11 preheated to within a predetermined temperature range. At the temperature specified in practicing this invention, the degradation of the PVC is such as to react the reaction mixture to produce a reaction product, which comprises hydrochloric acid, etches the surface of the conductor 11. The etching roughens the surface thereby promoting a surprisingly excellent adhesion of the PVC composition to the conductor.

In order to achieve a reproducible acceptable conductor-to-composition-adhesion of the insulating composition to a copper conductor 11, temperatures in the preferred range of 525° to 650° F are used. This will yield a bridle wire 13 having adhesion values in the range of 2 to 30 pounds and a drop wire values in the range of 8 to 32 with a 12 pound average.

It has been found that generally acceptable average composition-to-conductor adhesion values for solid conductor bridle wire have been obtained when using conductor preheat temperatures in the range of 525° to 650° F. In order to produce drop wire having preferred adhesion values in the range of 16 pounds, a temperature in the range of approximately 575° to 625° F is used.

Figure 5A:
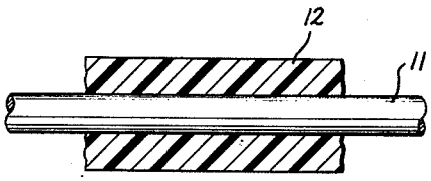
FIGS. 5A; 5B and 5C; are elevational, cross-section and elevational views, respectively, of an insulated in which the conductive element has been desirably preheated to within a controlled range to achieve controlled adhesion between the conductive element and the insulation and also showing a portion of the conductor with the insulation pulled therefrom.
Figure 5B:
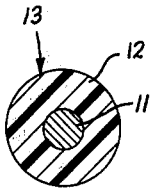
Figure 5C:
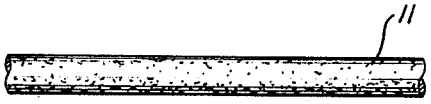

Conductors produced in accordance with the principles of this invention desirably have continuous insulation-to-wire contact as shown in FIGS. 5A and 5B. The wire-to-insulation adhesion achieved surprisingly by the principles of this invention is such that a pull-off of the insulation from the wire causes portions of the insulation to remain adhered to the wire surface (See FIG. 5C).

This process yields unexpected results in that the adhesion is achieved without compromising the physical and mechanical properties of the insulation. Priorly, it was believed that heating a PVC composition to temperature within the state range would degrade the PVC. In fact, the degradation of the PVC merely occurs at the conductor interface and is advantageously just sufficient to liberate the reaction product.

Test have shown that the adhesion varies with respect to the conductor preheat temperature. There is a critical lower limit below which the adhesion begins a decline with non-reproducible unacceptable results. As an example, insulation extruded over a conductor 11 preheated to generally below 450° F was found to be unacceptable and capable undesirably of being pulled manually from the conductors.

Figure 6A:
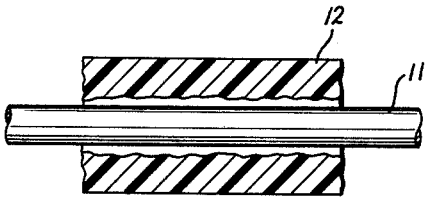
FIGS. 6A and 6B and 6C are elevational, cross-section and elevational views, respectively of an insulated in which the conductive element has been heated beyond the controlled range and showing adverse effects on the insulation and the portion of the conductor with the insulation pulled therefrom.
Figure 6B:
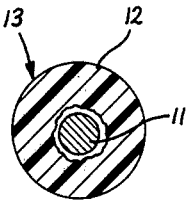
Figure 6C:
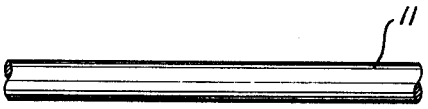

There is also an upper limit of temperature beyond which the adhesion values are affected adversely by the thermal degradation of the insulation. It has also been found that after a conductor preheat temperature of approximately 650° F, the adhesion of the insulation to the conductor decreases. Apparently, conductor preheat temperatures in excess of 650° F causes voids to occur at the insulation metal interface. In fact, it has been found that there may be no contact of the insulation with the metal wire (see FIGS. 6A and 6B). The insulation 12 is pulled from the wire with only slight amount of the insulation remaining adhered to the surface of the wire (see FIG. 6C)

The order to test the adhesion of the composition to the conductors 10—10, the plastic covered drop wire 12 is subjected to what is referred to as a slip-off test. This test is described in detail in the hereinbefore-referred-to application Ser. No. 412,362 incorporated hereinto by reference.

The attainment of the unexpected superior adhesion as a result of a reaction product of the PVC etching the conductor surface advantageously permits the elimination of the epoxy resin ingredient which has heretofore been used in the insulating composition for bridle wire 13 and to some extent in the drop wire 16. The acid is liberated as a result of the degradation of the PVC at the conductor-insulation interface and it roughens the conductor surface.

The bridle wire 13 is also subjected to various tests such as a compression test. an elongation test, low temperature flexibility, clamp holding and impact tests, all of which are described in the aforementioned application Ser. No. 412,362, incorporated by reference hereinto and in aformentioned application Ser. No. 515,266.

The following example illustrates a flexible PVC insulation composition prepared in accordance with the invention. All amounts are in parts by weight.

EXAMPLE

A copper conductor 11 is advanced at a line speed of 300 fpm and is preheated to a temperature of approximately 575° F. The preheated conductor 11 is advanced through the extruder 33 whereat the PVC composition is extruded thereover. The composition or reaction mixture included 100 parts, by weight, or a polyvinyl chloride resin, GP5-00003-ASTM-D1755, 47.7 parts. by weight, of mixed N-octyl, n-decyl phthalate plasticizer, 5.0 parts by weight, of dibasic lead phosphite stabilizer, 3 parts by weight of calcined clay, 0.5 part by weight of dibasic lead stearate lubricant and 2.5 parts, by weight, of carbon black, were mixed together and extruded over conductors preheated to a temperature of 575° F.

TABLE I

| | Test Results for Example at Varying Preheats | | | | | | | | | | |
|---|---|---|---|---|---|---|---|---|---|---|---|
| Preheat Temp. of Wire (° F) | 425 | 450 | 475 | 500 | 525 | 550 | 575 | 600 | 625 | 650* | 675 |
| Average Adhesion of Insulation to Conductors (Lbs.) | 0 | 4.5 | 6.5 | 7 | 6.75 | | 9 | 11 | 16.5 | 31 | 0 |

*Wire preheat temperatures in excess of 650° F tend to have a degrading effect on the insulation composition. Moreover, wire preheat temperatures beyond 650° F undesirably require extended cooling before being advanced in engagement with sheaves.

It is to be understood that the above described arrangements are simply illustrative of the invention. Other arrangements may be devised by those skilled in the art which will embody the principles of the invention to fall within the spirit and scope thereof.

What is claimed is:

1. A method of covering a electrical conductor conductor with a composition to obtain a controlled adhesion of the composition to the conductor member, which includes the steps of:

advancing the conductor member along a path;

preheating the conductor member to a temperature within a temperature range of approximately 525° F to 650° F; and extruding over the conductor member while the temperature thereof is substantially within the specified temperature range an epoxy resin-free composition which consists essentially of a plasticized polyvinyl chloride, a stabilizer, a filler system, a lubricant, and a carbon black constituent, the composition upon being exposed to the specified predetermined temperature range characterized by the release of a reaction product at the interface of the conductor and the composition which treats the outwardly facing surface of the conductor in a manner to cause a controllable adhesion of the composition to the conductor.

2. The method of claim 1, wherein the reaction product being hydrochloric acid which is liberated from the polyvinyl chloride composition at the interface with the conductor which etches the surface of the conductor.

3. The method of claim 2, wherein the adhesion of the composition to the conductor is consistently within the range of 2 to 30 pounds.

4. The method of claim 2, wherein the composition consisting essentially of 100 parts by weight of the polyvinyl chloride; 45 to 55 parts by weight, per 100 parts by weight of the polyvinyl chloride, of a phthalate plasticizer; 3 to 7 parts by weight, per 100 parts by weight of the polyvinyl chloride, of a metallic stabilizer; 3 to 10 parts by weight, per 100 parts by weight of the polyvinyl chloride, of a filler system; 0.25 to 0.75 parts by weight, per 100 parts by weight of the polyvinyl chloride, of a lubricant; and 1 to 3 parts by weight, per 100 parts by weight of the polyvinyl chloride, of a carbon black constituent.

5. The method of claim 2, wherein the composition includes 100 parts by weight of a polyvinyl chloride (PVC) resin homopolymer; 48 parts by weight, per 100 parts by weight of PVC, of a phthalate plasticizer; 5 parts by weight, per 100 parts by weight of PVC, of a dibasic lead phosphite metallic stabilizer; 3 parts by weight, per 100 parts by weight of PVC, of a calcined clay; 0.5 parts by weight, per 100 parts by weight of the PVC, of a dibasic lead stearate lubricant; and 2 parts by weight, per 100 parts by weight of PVC, of carbon black.

6. An insulated electrical conductor which includes conductor covered with a plasticized polyvinyl chloride composition and manufactured in accordance with the steps of claim 1.

* * * * *

UNITED STATES PATENT OFFICE

CERTIFICATE OF CORRECTION

Patent No. 4,020,213 Dated April 26, 1977

Inventor(s) SVEN RAYMOND BERGLOWE, JR. and EARL SALVATOR SAUER

It is certified that error appears in the above-identified patent and that said Letters Patent are hereby corrected as shown below:

In the specification, Column 2, line 43, "an insulated" should read --a conductor--; Column 4, line 7, "dverse" should read --adverse--;

Column 4, line 21, "les" should read --less--;

Column 6, line 47 "mixture" should read --product--; Column 6, line 63, "in" should read --the--; Column 7, line 66, "the" should read --to--; Column 8, line 46, "Test" should read --Tests--; Column 9, lines 58 and 59, delete first occurence of "conductor"; Column 9, line 60, delete "member"; Column 9, line 62, delete "member"; Column 10, line 1, delete "member"; Column 10, line 4, delete "member"; Column 10, line 25, "consisting" should read --consists--.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,020,213
DATED : April 26, 1977
INVENTOR(S) : Sven Raymond Berglowe, Jr. et al It is certified that error appears in the above-identified patent and that said Letters Patent are hereby corrected as shown below:

Column 4, line 18, "5" should read -- 5 ---

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*